428-911 SR
4/19/88 XR 4,738,893

United States Patent [19]
Grillo

[11] Patent Number: 4,738,893
[45] Date of Patent: Apr. 19, 1988

[54] FLEXIBLE AND MODULAR ARMOR PLATING DEVICE

[75] Inventor: Christian C. G. Grillo, Bornel, France

[73] Assignee: Hutchinson, Paris, France

[21] Appl. No.: 910,720

[22] Filed: Sep. 24, 1986

[30] Foreign Application Priority Data

Sep. 27, 1985 [FR] France ..... 85 14343

[51] Int. Cl.[4] ..... B32B 3/04; B32B 3/26
[52] U.S. Cl. ..... 428/252; 156/182; 428/267; 428/911
[58] Field of Search ..... 428/911, 252, 267

[56] References Cited

U.S. PATENT DOCUMENTS 4,443,506 4/1984 Schmolmann ..... 428/911
4,522,871 6/1985 Amellino ..... 428/911

*Primary Examiner*—Marion C. McCamish
*Attorney, Agent, or Firm*—Cushman, Darby & Cushman

[57] ABSTRACT

A device is provided for protecting a structure against the impact of projectiles and explosion fragments or splinters, which is of the type having a laminated elastomer and fiber based structure, formed preferably by organic aromatic polyamide fibers.

This laminated structure includes at least one flexible module formed of a plurality of superimposed composite layers, each composite layer including an intermediate textile layer and adhered on each side to a film of very small thickness made from elastomer, the different composite layers being bonded together by vulcanization and their number depending on the desired degree of flexibility for the module. The flexible module is adapted to be applied, preferably by bonding, but also by screwing or riveting or any other appropriate means, to any support, made from metal or not, curved or not, formed particularly by the structure to be protected or by another protection device of a type known per se already possibly equipping this structure or else by another module of the same type.

14 Claims, No Drawings

FLEXIBLE AND MODULAR ARMOR PLATING DEVICE

BACKGROUND OF THE INVENTION

1. Field of the Invention

The present invention relates to a protective device resisting the impact of projectiles and fragments or splinters from explosions, which is intended more particularly for the protection of motor vehicles.

2. Description of the Prior Art

Several solutions have already been proposed for forming armor plating devices which, in almost all cases, have a composite laminated structure having at least one layer of inorganic (or natural) fibers, such as glass fibers, or organic (or synthetic) fibers, such as polyamide fibers ("NYLON") and especially aromatic polyamide ("KELVAR"), these latter being pratically universally used in the manufacture of ballistic protective devices, because of the high specific mechanical resistance, per unit of mass, of "KEVLAR" (which is a well known trademark registered by DUPONT DE NEMOURS) which is five times greater than the specific resistance of steel and double the specific resistance of "NYLON", "KEVLAR" also having the property of absorbing large amounts of kinetic energy.

By way of examples of solutions already proposed, a certain number of patents may be mentioned whose object is briefly recalled hereafter.

The VALLCORBA TURA, FR No. 2 348 991, relates to a textile foil for making cloths resistant to shocks and explosions, which is formed by an aramide (or aromatic polyamide) particularly KEVLAR, from 500 to 2500 deniers, and in particular 1000 deniers, woven with a simple cloth weave and covered in the mass, said filament being fixed firmly by coating with at least one impermeable resin face by passing it through a gelification tunnel, from which it leaves ready for making bullet-proof jackets, for example.

For the bullet-proof jacket to be efficient, the tissue is folded back on itself, which gives a laminated structure which may comprise a maximum number of 30 to 40 folds, ensuring protection against the impact of projectiles in the case of war and combats, explosions (dynamite), hunting as a sport.

Anti-explosion blankets may also be formed.

Between the successive layers of aramide fibers can be disposed free aramide fibers or any other type of refractory fibers such as "FIBERFRAX", "KAOXOOL", "TRITON", "CERAFIBER", "REFRASIL", etc. . . . , the inclusion of these free fibers being however not indispensable.

The BOTTINI et al. patent FR. No. 2 402 855, relates to a composite bullet-proof material, which may be formed as flat or curved foil as well as hollow bodies of complex form. It is composed of a plurality of aromatic polyamide fiber fabrics (ballistic "NYLON"), some at least of which are of ordinary "linen" type and others of the "batavia" type, each being impregnated with unsaturated polyester resins, which fabrics are superimposed on each other one by one or in groups, the mutual association being obtained at high pressure depending on the desired shape. In the case where only two fabrics of the above-mentioned type are used, the tissues of the "batavia" group are superimposed parallel or perpendicularly to the adjacent "linen" fabrics.

This patent corresponds to U.S. Pat. No. 4,200,677.

The Patent of the INSTITUT FRANCO-ALLEMAND DE RECHERCHES DE SAINT-LOUIS, FR. No. 2 425 046, relates to an armor plating device proof against projectiles and formed by a first plate exposed to the impact of the projectiles and made from a hard material, such as steel, whose thickness is greater than or equal to 0.3 times the caliber of the projectiles from which the armor plating device is to protect and by a second plate made from laminated material with low delaminating energy, whose thickness is at least equal to twice the caliber of the projectiles and is formed of inorganic fibers, such as glass fibers, or organic fibers, such as aromatic polyamide fibers (or aramide fibers), which fibers are bonded together by a soft resin, that is to say manufactured with a small amount of hardener, such a polyester resin, or are bonded by means of a natural or synthetic elastomer.

The two plates are assembled by bonding or by continuous or discontinuous mechanical means.

The IMI KYNOCH LTD Patent, FR No. 2 443 397, relates to a receptacle for storing dangerous materials, for example explosives, whose wall has a laminated structure comprising at least one relatively rigid layer, made from a plastic material, particularly a heat setting material, reinforced with fibers, particularly glass or polyamide fibers, and at least one elastomer layer, made more particularly from chlorosulfonated polyethylene, the rigid layer being closer to the inside of the receptacle than the elastomer layer.

In the case where the wall of the receptacle comprises several rigid elastomer layers, they are disposed alternately.

The laminated structure may also include an external metal layer.

The Patent of the SOCIETE NATIONAL DES POUDRES ET EXPLOSIFS, FR No. 2 469 277, relates to a device for protecting against shocks, due more particularly to the impact of a bullet or of fragments projected by an explosion, or else due to collisions between two bodies, for example two vehicles.

This device is of the type having laminated structure formed of superimposed layers of basic inorganic fiber fabrics, such as glass fibers or organic fibers, such as aromatic polyamide or aramide ("KEVLAR") fibers and an impregnating resin, particularly polyester or polyepoxide. This Patent claims the use in the protective device of the above-mentioned type of thermosetting or thermoplastic viscoelastic resin having a loss factor between 0.5 and 1.5, a modulus of elasticity between $10^6$ and $10^9$ N/m$^2$, at a frequency of 100 Hz and at the temperature of use.

The proportion by weight of viscoelastic resin, with respect to the total weight of the protective device, is between:

10% and 30%, and preferably between 15% and 24%, in the case of forming light armor plating, or 40% and 80% in the case of forming motor vehicle bumpers.

The APPRICH Patent, FR No. 2 506 447, relates to armor plating for wall elements, particularly for the metal parts of the underneath of motor vehicles, for protecting against the action of explosive devices, including at least one layer of a coherent fiber mat impregnated with resin.

The fibers may be wholly aramide (aromatic polyamides) fibers and in particular "KEVLAR" fibers.

In the case where said mat is made only partially from aramide fibers, it may also comprise cotton fibers or polyamide fibers.

In each case, the mat may be formed by a fabric having several layers of warp threads and weft threads, connected with each other.

The impregnating resin is a resin with one or more components, in particular a polyurethane, polyethylene or polyvinyl chloride resin.

The AEROJET Patent, FR No. 1 605 066, relates to a material resisting shocks, whose resistance to penetration/weight ratio is exceptionally high and which may be used for forming breast plates for human beings or armor plating for air transport apparatus, personnel transport devices, etc. . . .

The material proposed includes several bonded layers of a material formed by interlacing glass fibers, particularly in the form of roves, and "NYLON", impregnated with resin, particularly polyester, epoxy or phenolic rubber.

The relative proportions by weight of the glass and "NYLON" fibers are between 90 parts of glass and 10 parts of "NYLON", and 10 parts of glass and 90 parts "NYLON".

The results of testing for resistance to shocks of this combination of fibers are better than the results obtained with one or other type of fibers used separately.

The said shock resistive material may also include an external surface layer of glass, alumina, boron carbide, silicon carbide, etc . . .

The Patent MAN MASCHINENFABRIK, DR No. 2 522 404, relates to an armor plating element in the form of a plate, of the type formed by:

- a plate made from hard material causing the projectile to explode, directed on the firing side,
- a packing material decelerating the projectile, disposed on the rear face of this plate, and
- a layer with a high elongation at rupture, disposed on the front face of said plate.

According to this patent, the layer with high elongation at rupture is made from polyurethane, the hard material plate is made from sintered aluminium oxide or boron carbide ceramic and the backing material is a textile fiber fabric, particularly aromatic polyamide fibers, formed by several loosely superimposed layers and only weakly bonded together.

The packing material may be coated upon one side with said hard material and protected against humidity, in the zone not covered with this hard material, by hardenable synthetic impregnating resins.

The American Patent MEDLIN, U.S. Pat. No. 4,352,316, relates to armor plated vehicles with light armor plating, having the appearance of normal vehicles, and more particularly a light protective plate capable of dissipating at least a part of the kinetic energy of high speed projectiles. This bulletproof plate comprises:

- a plurality of ballistic foils (namely, resisting penetration by high speed projectiles) forming ballistic fibers,
- a dressing material, and
- a connecting material which bonds itself imperfectly to this dressing material.

The dressing material is applied to said plurality of foils and the foils thus dressed are laminated together by means of the binder, so as to become delaminated under the action of the impact of high speed bullets.

The plate proposed by the MEDLIN, U.S. Pat. No. 4,352,316, conforms to the results of tests according to which the most efficient means for absorbing the kinetic energy of a projectile is to deform, separate (or delaminate) and penetrate a number of separate armor plating foils.

Worthy of note is also the European Patent CAPPA, EP No. 49 014, although it departs from the scope of the present invention because, contrary to the known technique, the impact resistance is improved by giving to the laminated structure an undelaminable structure, namely a structure which interconnects the different layers of laminated material so as to confer on the whole the capacity of resiliently absorbing the impact due to the projectile without becoming delaminated.

It is a question of an improved non-metal screen which is highly resistant to the impacts of projectiles and of the type formed by the alternating superimposition of thermoplastic resin and textile material layers, which bulletproof protective screen comprises:

- a honeycomb matrix which is obtained by heating and compressing said thermoplastic resin and which forms a 3-dimensional support,
- textile material layers formed by noble synthetic fibers, such as carbon, aramide, boron or similar fibers, which have exceptionally high mechanical properties and which are interlaced and contained freely in the cavities of said honeycomb structure and incapsulated by these cavities, i.e. the fibers are free to slide along the corresponding cavity.

The undelaminable structure is obtained by applying rules, most of which are contrary to the usual practice and particularly by providing a negligible or zero adherence, or connection, between the matrix and the fibers, which is obtained by choosing appropriate raw materials for the matrix and the fibers, or by treating these fibers with an agent which makes them impermeable to the matrix.

The foregoing shows:

- on the one hand, that, for forming flexible structures, particularly adapted to the formation of bulletproof jackets, one is limited to the use of textile foils folded on themselves (cf. the VALLCORBA TURA Patent), however this solution is not suitable for forming armor plating for motor vehicles particularly, and
- on the other hand, that the adaptation of textile foils to the formation of armor plating devices requires the cooperation with plates or layers of a certain rigidity, the textile foils being almost generally impregnated with a resinous or elastomer bonding agent (only the Patent IMI/KYNOCH LTD describes a protection device whose laminated structure has at least one layer formed completely of elastomer, but also this latter cooperates with at least one rigid layer).

Furthermore, adaptation to particular shapes, generally curves, of objects to be projected is subordinated to the application of high pressure forming methods (cf. the BOTTINI Patent) or, in some cases, hot forming (this is the case of devices using laminated plastic material panels appropriately reinforced).

To sum up, it may then be concluded that the armor plating devices at present available are of a rigid or semirigid type which, while offering efficient protection, have a certain number of drawbacks, not only in so far as their manufacture, but also in so far as their use is concerned, which limit the applications thereof, particularly:

in so far as the shaping to curved supports is concerned, this is only possible by having available a special mold, which is generally expensive, and whose use is justified essentially in the case of large-scale production, in so far as the cutting up of the pieces is concerned, it is difficult, which requires tools which are also special, such as diamond-tipped saw teeth, high pressure water jet devices or laser devices, in so far as the dimensions of the pieces are concerned, they are available in a relatively limited range, particularly because of the cutting out problems, in so far as the hygiene and work safety conditions are concerned, they imply the respect of strict standards because of the presence of volatile resins, and in so far as the manufacture of the pieces is concerned, it takes place in the presses or in autoclaves, which involves a high number of manual operations, particularly due to the superimposition of the layers of these stratified structure pieces, and so long periods of immobilization of the machines which raises the energy cost.

SUMMARY OF THE INVENTION

The purpose of the present invention is to provide a protection device resisting the impact of projectiles and fragments or splinters from explosions and is intended more particularly for armor plating motor vehicles, which device answers better the requirements of practice than the devices relating to the same purpose known heretofore, particularly in that:

it is adapted to be shaped manually to any metal or nonmetal support, curved or not, for equal performances, a considerable gain in weight is obtained and so reduction of the cost of the material required, cutting out is readily achieved, using ordinary cutting tools, such as a scalpel, cutter and similar, the manufacturing and application times are short, the manufacture being continuous.

The present invention has as object a device for protecting a structure, more particularly formed by a motor vehicle, against the impact of projectiles and fragments or splinters from explosions, said device being of the type having a laminated structure based on elastomer and fibers, formed preferably by organic aromatic polyamide fibers, which device is characterized in that said laminated structure comprises at least one flexible module formed of a plurality of superimposed composite layers (or folds), each composite layer having an intermediate textile layer made from said fibers and bonded on each side to a film of very small thickness made from said elastomer, the different composite layers being bonded together by vulcanization and the number thereof depending on the degree of flexibility desired for the module, and said module is adapted to be applied preferably by bonding, but also by screwing or riveting or any other appropriate means to any support, metal or not, curved or not, formed particularly by said structure to be protected or by another protection device of a type known per se possibly already equipping this structure or else by another module of the same type.

According to an advantageous embodiment of the device of the invention, the number of said composite layers is between 5 and 20 and preferably between 5 and 10.

According to another advantageous embodiment of the device of the invention, each thin elastomer film adhered on each side with respect to each textile layer, has a thickness between 0.01 and 0.018 mm and an adherence between about $5.10^2$ N/m and $29.10^2$ N/m, and the percentage by weight of elastomer product used in a given module is between 7% and 15% of the total weight of the module.

According to the another advantageous embodiment of the device of the invention, the bonding agent for connecting one module to the preceding module, looking in the direction opposite that of the propagation of projectiles or ejection of fragments, or directly to said support, is of the type having an elongation power sufficient to absorb a part of the kinetic impact energy and a good adherence, particularly of the order of $49.10^2$ N/m, namely an appropriate crosslinking rate, preferably between 1 and 20.

In a preferred embodiment of the device of the invention, it comprises a plurality of modules of said type, at least one intermediate module of which includes said textile layers made from fibers having rupture strength and a number of warp and weft threads which is smaller with respect to at least a module which precedes it, looking in the direction opposite that of the propagation of projectiles or the ejection of fragments, but which is higher with respect to at least one module which follows it, if that exists.

In a prefered arrangement of this embodiment, the device has at least one so-called primary module, which is exposed to the projectiles or fragments and at least one so-called secondary module, which follows it viewed in the direction opposite that of the propagation of projectiles or the ejection of fragments, which primary module has a sizing between 1100 and 1680 dtex, a number of warp and weft threads equal to or greater than 10.5 and a warp and weft break strength equal to or greater than $186.10^3$ N/m, whereas the secondary module has a sizing between 1680 and 3300 dtex, a number of warp and weft threads equal to or greater than 3.7 and warp and weft breakage resistance equal to or greater than $137.10^3$ N/m.

In an advantageous embodiment of the device of the invention, it includes a plurality of modules of said type, each of which has a sizing between 1100 and 1680 dtex, a number of warp and weft threads equal to or greater than 10.5 and warp and weft breakage resistance equal to or greater than $186.10^3$ N/m.

Besides the preceding arrangements, the invention comprises other arrangements which will be clear from the following description.

DESCRIPTION OF THE PREFERRED EMBODIMENTS

Hereafter will be given a definition of ballistics which will be useful to a better understanding of what is set forth in the following complement of description.

It is known that when a projectile impacts armor plating, a spherical wave originates at the collision point. Now, this wave is broken down into two successive waves, namely:

a longitudinal wave which propagates at the speed of sound perpendicularly to the direction of propagation of the projectile and which therefore subjects the material (contained in a plane perpendicular to the path traveled by the projectile, to a tensile stress proportional to the speed of sound; and a transverse wave which propagates at the speed of the projectile (so at a lower speed) parallel to the direction of propagation of the projectile and which causes the material to move perpendicularly to the axis of the fibers, i.e. parallel to the path traveled by the projectile, this phenomenon being better known under the name of "delamination" or "destratification".

The different tests carried out on the modules of the invention, described above, having a constant number of intermediate layers, identical textile weaving and elastomer films having different mechanical properties and adherences have given the following information:

on the one hand, with the module having high adherence films, namely greater than $39.10^2$ N/m and low elongation at rupture, the two following cases occur:

- if perforation of the armor plating is total, no delamination is observed;
- if the perforation is partial, the delamination appears in a point situated between 50 and 70% of the thickness and deformation of the rear part of the device is small, whereas
- on the other hand, with modules having a low adherence film, i.e. between $5.10^2$ N/m and $29.10^2$ N/m and high elongation, penetration is partial, delamination appears at a point situated between 10 and 40% of the thickness and deformation of the rear part of the device is great.

These observations concerning the behavior of the armor plating devices of the invention have led:

- on the one hand, to confirming the decisive role of delamination in the absorption of the kinetic energy of the projectile, the stopping of which is determined by the nature and thickness of the elastomer film; and
- on the other hand, to thinking that the maximum stress causing the rupture of the threads is situated in the front face of the device, so that as the projectile penetrates into the armor plating, formed particularly by two superimposed modules of the invention, and is crushed, the movement of the material behind the transverse wave loads the threads of the secondary module and unloads the threads of the primary module.

It is therefore advantageous to replace the threads of the secondary module by threads having a lower resistance to rupture and a smaller number of warp and weft threads. Besides lightening the mat thus formed, this arrangement brings a reduction in the cost of material.

It goes without saying that it would be possible to replace the secondary module by any foil material capable of assuming a curved shape (i.e. having a flexibility comparable with that of the primary module), provided that it has equivalent properties of resistance to rupture.

For the two above-mentioned reasons, when the armor plating of the invention includes several superimposed modules, it is formed from at least two of such modules having characteristics and performances which differ in the said sense; for example, the device of the invention may include:

- a first module placed on the front face and so advantageously formed of a fabric with a relatively high number of threads and having a high warp and weft resistance, whose sizing is between 1100 and 1680 dtex, whose resistance to rupture is greater than or equal to $186.10^2$ N/m of length, and in which the number of warp and weft threads is greater than 10.5; and
- a second module placed at the rear face, and so advantegously formed of a fabric having a lower resistance and a reduced number of warp and weft threads, whose sizing is between 1680 dtex and 3300 dtex, whose resistance is at least equal to $137.10^3$ N/m, and in which the number of warp and weft threads is greater than or equal to 3.7.

In so far as the thickness of the elastomer thread and its mechanical properties are concerned, one and the other defines conditions essential for the performance of the armor plating. In fact, a film having a low adhesion power, for example of the order of about $5.10^2$ N/m to $29.10^2$ N/m, allows delamination of the fabric layers, but in any case must keep its high elongation capacity, whereas the increase in the thickness of the film reduces the path of the longitudinal wave and results in a greater depth of penetration of the projectile; on the other hand, a thick film increases the imprisonment of the threads, which limits their elongation power and concentrates the stress in the impact zone, the threads being subjected to greater shearing. Moreover, it is also known that the longitudinal wave is reflected all the more the smaller the number of warp and weft threads; now, the components of the reflected wave are superimposed on the components of the initial wave and break the threads in the impact zone, if the amplitude exceeds the resistance of the threads at this point; consequently, the lower the reflection of the wave, the more energy is absorbed by the threads in the vicinity of the impact.

For that, the thickness of the film must be advantageously between 0.01 and 0.018 mm, which represents a percentage by weight with respect to the total weight of the material used between 7 and 15%.

Its 100% module is between $10^8$ N/m$^2$ and $5.10^8$ N/m$^2$.

The elastomer of the film is further advantageously formulated so as to have fireproof properties.

The thickness of each of said intermediate textile layers of each composite layer which comes into the construction of a flexible module of the invention is preferably about 0.35 mm before the operation of adhering the textile layer on each side to the elastomer film.

Obviously, after the adhering and vulcanization operations, the thickness of the textile layers decreases.

In so far as the vulcanization of the modules of the invention is concerned, it takes place, as distinct from the known methods for rigid and semi-rigid armor plating, under a low pressure, more particularly less than about $29.10^4$ Pa (=2.9 bar), and at a high temperature, particularly between 150° and 170° C., which also implies a short holding time.

Although the armor plating of the invention rarely finds an application when it is used alone, on the other hand because of its modularity it may bring a complement of protection to an existing element, such for example as a motor car body or even to a high hardness metal armor plating.

It is also known that the association of steel with "KEVLAR" reduces the penetration of a projectile. However, it is possible to improve the performance of such an assembly by certain arrangements in the assembly of these elements.

In fact, tests carried out with a primary protection (soft steel sheet with a thickness of 0.5 to 1 mm intended for stamping) associated without bonding with the modules of the invention demonstrates that this assembly offers a lower stopping power, in comparison with the assemblies whose devices are heavily bonded.

In this connection, some explanations may be given, namely:

in the absence of bonding, when a projectile impacts the metal part, a part of the longitudinal wave is diffused at high speed in the metal sheet without being decelerated, which reduces the stresses in the primary modules;

when the metal sheet is heavily bonded to the flexible and modular armor plating of the invention, it strongly resists the advance of the projectile, which is thus slowed down; the flexible armor plating then undergoes considerable deformation which tends to better distribute the stress in the threads, whereas the deformation of the metal sheet loads the threads of the primary module over a larger zone.

To benefit from the advantages of bonding, the bonding agent between the superimposed modules must have good adherence, particularly of the order of $49.10^2$ N/m, and an elongation power sufficient for absorbing a part of the kinetic energy. To this end, a good compromise is found with a bonding agent whose cross-linking rate is between 1 and 20.

By way of non-limitative example, we give below, in the form of a diagram, some possible compositions of the modular armor plating device of the invention used alone and in cooperation with steel sheet bonded to the front face, this steel sheet being of a different thickness and simulating for example the metal sheet of the bodywork of a motor vehicle.

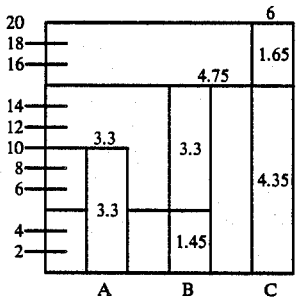

Composition A refers to the case where to the front face is bonded a metal sheet whose thickness is between 1 and 1.2 mm and composition B relates to the case where there is bonded to the front face a metal sheet whose thickness is between 0.5 and 0.7 mm, whereas composition C is relative to the absence of a metal sheet on the front face.

Along the vertical left-hand axis is shown the number of composite layers which come into the composition of each of the modules, from which the armor plating device is formed.

In each case it is possible to stop an armored 9 mm projectile (a projectile in the form of a shell, with a lead core and a copper jacket) having a weight of 8.1 g, a speed of 380 m/sec, the weapon used having a length of 6" (≃15.24 cm).

The hatched rectangles refer to modules whose textile in "KEVLAR" weave a sizing of 3300 dtex, whereas the unhatched rectangles refer to modules whose textile "KEVLAR" weave has a sizing of 1100 dtex. At the top of each rectangle is shown the total mass of the device in kg/m², whereas inside each rectangle is shown the mass in kg/m² of each of the corresponding modules from which the armor plating device is formed.

Summing up the foregoing, it is therefore clear that:

case A corresponds to a device having a mass per m² of 3.3 kg/m² and formed by a module:
- which has 10 composite layers;
- whose textile weave has a sizing of 1100 dtex;
- whose mass to the m² is 3.3 kg/m²; and
- which cooperates on the front face with a metal sheet of 1 to 1.2 mm;

case B corresponds to a device having a mass to the m² of 4.75 kg/m² and formed by:
- a primary module on the front face:
  - which includes 15−5=10 composite layers
  - whose textile weave has a sizing of 1100 dtex;
  - whose mass to the m² is 3.3 kg/m²; and
- a secondary module on the rear face:
  - which comprises 5 composite layers;
  - whose textile weave has a sizing of 3300 dtex;
  - whose mass to the m² is 3.3 kg/m²; and which cooperates on the front face with a metal sheet of 0.5 to 0.7 mm;

case C corresponds to a device having a mass to the m² of 6 kg/m² and formed by:
- a primary module on the front face:
  - which includes 20−15=5 composite layers;
  - whose textile weave has a sizing of 1100 dtex;
  - whose weight to the m² is 1.65 kg/m²; and
- a secondary module on the rear face:
  - which has 15 composite layers;
  - whose textile weave has a sizing of 3000 dtex;
  - whose weight to the m² is 4.35 kg/m²;

this latter device being used alone, i.e. without a metal sheet on the front face.

Now, considering that the examples of composition and combination may be increased to infinity, it is clear that the advantage of the compositions and combinations which have just been described resides in the fact that they show certain possible solutions for stopping a given projectile in given circumstances.

A variant of the above-described solution, applicable to weapons of low and medium power (classes I to III), finds application for high speed splinters.

Within the scope of the present invention, by classes I, II and III are meant the classes relating to projectiles propelled by hand weapons, whose speeds go from about 280 m/sec in class I to about 540 m/sec in class III.

It is well known that "KEVLAR" cannot be used alone for very high speed projectiles, i.e. situated beyond said class III. In fact, beyond 500 to 550 m/sec, the material only undergoes a shearing effect, the increase in the weight of the material used not resulting in a proportional reduction of the speed.

Now, "KEVLAR" readily decelerates small rate splinters at high speed, but it decelerates insufficiently heavier weight splinters at low speed.

The solution which is adopted within the scope of the present invention, for overcoming this drawback, consists in providing flexible modules each formed of the plurality of composite layers (or folds) of said type each cooperating with a metal sheet of very small thickness which follows the corresponding composite layer viewed in the direction opposite that of the projection of the projectiles or of ejection of the fragments and which is also adhered, like said textile layer, on each side to an elastomer film of very small thickness, the different composite layers thus formed being joined together by vulcanization and their number depending on the desired degree of flexibility for each module. In this case, the best ballistic performance is obtained with a module whose minimum sizing of the textile "KEVLAR" weave is 1100 dtex, the number of warp and weft threads being high and in any case at least equal to 10.5 with a warp and weft resistance to rupture equal to or greater than $186.10^3$ N/m, whereas the metal sheet, formed more particularly of high strength steel sheet, has a very small thickness, preferably between 0.03 and 0.1 mm—which contribute to keeping the necessary characteristic of flexibility for the variant in question—and a resistance to rupture which is greater than $4905.10^5$ Pa (=4905 bar) as well as a Rockwell B hardness which is equal to or greater than 76. In so far as the elastomer film is concerned, it has characteristics identical to those of the module without metal sheet.

Now, the performance to splinters is explained by a longitudinal wave better diffused in the metal, which results in distributing the stresses more uniformly. One the other hand, the metal sheets, as in the case of a metal sheet placed solely on the front face, undergoes successive deformations which considerably slow down the speed and penetration of the splinter.

As is clear from the foregoing, the invention is in no way limited to those of its embodiments and modes of application which have just been described more explicitly; it embraces on the contrary all the variants thereof which may occur to the mind of the technician skilled in the matter without departing from the scope or spirit of the present invention.

What is claimed is:

1. A device for protecting a structure against the impart of projectiles and explosion fragments or splinters, said device being of the type having a laminated structure based on elastomer and fibers, wherein said laminated structure has at least one flexible module formed of a plurality of superimposed composite layers, each composite layer including an intermediate textile layer made from said fibers and adhered on each side to a film of very small thickness made from said elastomer, the different composite layers being bonded together by vulcanization and their number depending on the desired degree of flexibility for the module, and said module is adapted to be secured to any support formed by said structure to be protected.

2. The device as claimed in claim 1, wherein the number of said composite layers preferably ranges between 5 and 20.

3. A device as in claim 2 wherein said number composite layers preferably ranges from 5 to 10.

4. The device as claimed in claim 1, wherein each thin elastomer film adhered on each side with respect to each textile layer has a thickness between 0.01 and 0.018 mm and an adherence between about $5.10^2$ N/m and $29.10^2$ N/m and a percentage by weight of elastomer product used in a given module is between 7% and 15% of the total weight of the module.

5. The device as claimed in claim 1, including a bonding agent for connecting one module to a preceding module, viewed in the direction opposite that of propagation of the projectiles or ejection of fragments, said bonding agent being of the type having a sufficient elongation power to absorb a part of the kinetic impact energy and an adherence in the order of $49.10^2$ N/m, and an appropriate cross-linking rate, preferably ranging between 1 and 20.

6. The device as claimed in claim 1, including a plurality of modules of said type, in which at least one intermediate module includes the said textile layers made from fibers having resistance to rupture and a number of warp and weft threads which is smaller with respect to at least a preceding module, viewed in the direction opposite that of propagation of the projectiles or ejection of the fragments, said intermediate module having a rupture resistance which is higher with respect to any following modules.

7. The device as claimed in claim 6, wherein the device includes at least one primary module, which is exposed to the projectiles or fragments, and at least one following module, viewed in the direction opposite that of projectile propagation said primary module having a sizing between 110 and 1680 dtex, a number of warp and weft threads equal to or greater than 10.5 and a warp and weft resistance to rupture equal to or greater than $186.10^2$ N/m, said following module having a sizing between 1680 and 3300 dtex, a number of warp and weft threads equal to or greater than 3.7 and warp and weft resistance to rupture equal to or greater than $1.37.10^3$ N/m.

8. The device as claimed in claim 1, including a plurality of said modules each having a sizing between 1100 and 1680 dtex, a number of warp and weft threads equal to or greater than 10.5 and warp and weft resistance to rupture equal to or greater than $186.10^2$ N/m.

9. The device as claimed in claim 1, further comprised of a plurality of said flexible modules each formed of a plurality of composite layers of said type together with a metal sheet of very small thickness which follows the corresponding composite layer viewed in a direction opposite that of the propagation of projectiles and which is also adhered, like said textile layer, on each side, to an elastomer film of very small thickness, the different composite layers thus formed being bonded together by vulcanization with the number of composite layers depending on the desired degree of flexibility for each module.

10. The device as claimed in claim 9, wherein the metal sheets have a thickness preferably between 0.03 and 0.1 mm, a resistance to ruptured at least equal to $4905.10^5$ Pa and a Rockwell B hardness at least equal to 76, each module having a minimum sizing of 1100 dtex, a number of warp and weft threads at least equal to 10.5 with warp and weft resistance to rupture at least equal to 186.10 N/m.

11. The device as claimed in claim 1, wherein the elastomer film has fireproof properties.

12. A device as in claim 1 wherein said fibers are comprised of organic aromatic polyamide.

13. A method of covering a structure to be protected against the impacts of projectiles and explosion fragments or splinters, by means of a flexible device having a laminated structure based on an elastomer and fiber combination comprising the steps of forming at least one flexible module from a plurality of superimposed composite layers, forming each composite layer so that it includes an intermediate textile layer made from said fibers and adhered on each side to a film of very small thickness made from said elastomer, bonding different composite layers together by vulcanization with the number of layers being bonded together depending on the degree of flexibility for the module and bonding said flexible module to said structure, each module being previously continuously vulcanized at a pressure less than about $29.10^4$ Pa and at a temperature varying between 150° and 170° C., with short holding times.

14. The method as in claim 13 further including the step of bonding a plurality of said modules to said structure, and to each other one after another.

* * * * *